United States Patent [19]

Hakansson

[11] Patent Number: 4,778,053

[45] Date of Patent: Oct. 18, 1988

[54] PACKAGING CONTAINER WITH ATTACHED DRINKING STRAW

[75] Inventor: Jån Hakansson, Eslöv, Sweden

[73] Assignee: Roby Teknik Aktiebolag, Lund, Sweden

[21] Appl. No.: 167,014

[22] Filed: Mar. 11, 1988

[30] Foreign Application Priority Data

Mar. 24, 1987 [SE] Sweden ..... 8701212

[51] Int. Cl.[4] ..... B65D 85/14

[52] U.S. Cl. ..... 206/443; 206/217; 206/820

[58] Field of Search ..... 206/443, 446, 217, 471, 206/820

[56] References Cited

U.S. PATENT DOCUMENTS

| | | | |
|---|---|---|---|
| 3,443,683 | 5/1969 | Felty, Jr. et al. | 206/820 |
| 3,874,554 | 4/1975 | Chang | 206/217 |
| 3,910,410 | 10/1975 | Shaw | 206/564 |
| 4,036,392 | 7/1977 | Martin | 206/217 |
| 4,158,408 | 6/1979 | Thiessen | 206/564 |
| 4,260,058 | 4/1981 | Paull et al. | 206/820 |
| 4,293,369 | 10/1981 | Dilot et al. | 156/521 |
| 4,345,415 | 8/1982 | Järund | 53/450 |
| 4,362,075 | 12/1982 | Utsumi | 83/42 |
| 4,384,441 | 5/1983 | Maruyama et al. | 53/553 |
| 4,384,915 | 5/1983 | Utsumi | 156/499 |
| 4,512,472 | 4/1985 | Järund | 206/820 |
| 4,584,819 | 4/1986 | Hakansson | 53/410 |

*Primary Examiner*—Jimmy G. Foster

*Attorney, Agent, or Firm*—Burns, Doane, Swecker & Mathis

[57] ABSTRACT

A weblike package for suction tubes (1) comprising two straight tube parts (1*a* and 1*b*) which are joined flexibly by means of a bellows-folded, tubular intermediate part (1*c*). The package (2) comprises two flexible material webs which are joined to one another by repeated longitudinal and transversal sealing joints (6 and 7) which in pairs jointly form closed spaces (8) wherein suction tubes (1) are arranged. The suction tubes (1) are oriented straight with the free ends (1*a*' and 1*b*') of both their straight tube parts (1*a* and 1*b*) directed away from one another towards the longitudinal edges (5 and 5') of the material webs. Individual wrapped suction tubes (1) separated from the package are intended to be applied to the outside of a packing container with the longer straight tube part (1*a*) of the suction tube placed diagonally between opposite corners of the packing container, and with the shorter straight tube part (1*a*) of the suction tube bent parallel with the upper edge line of the packing container, and to make possible such an application of the wrapped suction tube without causing the surrounding envelope to burst the spaces (8) are provided with portions (8*a*, 8*b* and 8*c*) of mutually differing cross-sectional areas, the space portion (8*a*) in the region of, and closest to, the bellows-folded intermediate part (1*c*) having the largest cross-sectional area.

5 Claims, 2 Drawing Sheets

PACKAGING CONTAINER WITH ATTACHED DRINKING STRAW

Figure 1:
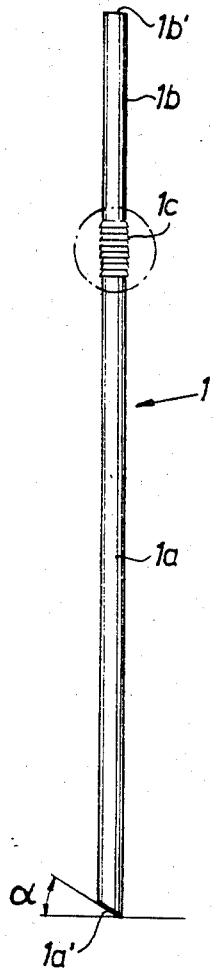

The present invention relates to a flexible weblike package for suction tubes of the type comprising two straight tube parts joined to one another flexibly by means of a bellows-type tubular intermediate part, the package comprising two flexible material webs which are joined to one another along repeated longitudinal and transversal sealing joints which in pairs jointly from closed spaces wherein suction tubes are arranged.

So-called nonreturnable packages, e.g. for juice, at present are frequently provided with a detachable suction tube applied to the outside of the package which is intended to facilitate the emptying of the contents of the packing container. The suction tube is manufactured from a flexible, but relatively rigid plastic material and may be used, therefore, to break open the packing container, e.g. by pushing the suction tube through a thinned or weakened part of the container wall.

On application of suction tubes to conventional substantially parallelepipedic packing containers the suction tube, which for reasons of hygiene is wrapped in a flexible protective envelope, is usually fixed diagonally over one of the plane, rectangular side walls of the packing container. So as not to be in the way when handling the packing containers in connection with transport and storage and also to protect it against mechanical damages during such handling it is important that the suction tube should be applied in such a manner that it does not with any part project outside the lateral edges of the container walls. However, this restricts the length of the suction tube which is not allowed, therefore, to measure more than the diagonal distance between opposite corners on the largest side wall of the packing container. when the suction tube has been disengaged from this side wall and is used for emptying the contents of the packing container, the length of the suction tube, therefore, may be inconveniently short, especially in case of packing containers of a certain shape and size.

In order to overcome this problem and to make possible the application of suction tubes of greater length within the contours of the largest plane lateral surface of the packing container it has been suggested, among other things, that the suction tube should be manufactured to comprise a flexible bellows-type central portion, so that the suction tube, prior to being wrapped in the flexible protective envelope, may be doubled up and thus can be accomodated with good margin inside the lateral edges of the container wall. One problem with such suction tubes is, however, that they are relatively difficult to pack in doubled up condition, and that in practice it is almost impossible to pack them in a flexible, weblike package which is required so as to permit, among other things, a rational handling of the suction tubes in connection with mechanical application to the packing containers. Furthermore, the known suction tubes packed in doubled up condition are quite difficult to release from their outer envelope in a simple manner when they are to be used and they are considered by the consumer, therefore, to be awkward to handle.

The said disadvantages are effectively overcome in accordance with the invention in that a package of the type described in the introduction is given the characteristics which are evident in more details from the subsequent claim 1.

Preferred embodiments of the suction tube package in accordance with the invention have been given, moreover, the characteristics described in the subsidiary claims.

Figure 2:
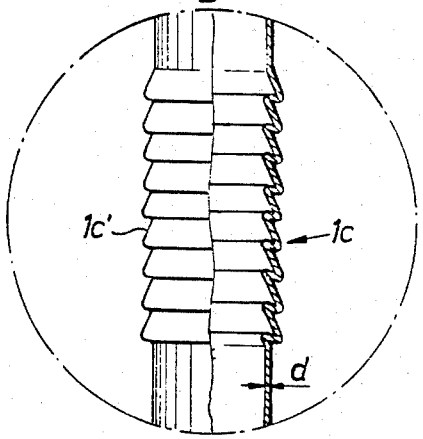
Figure 3:
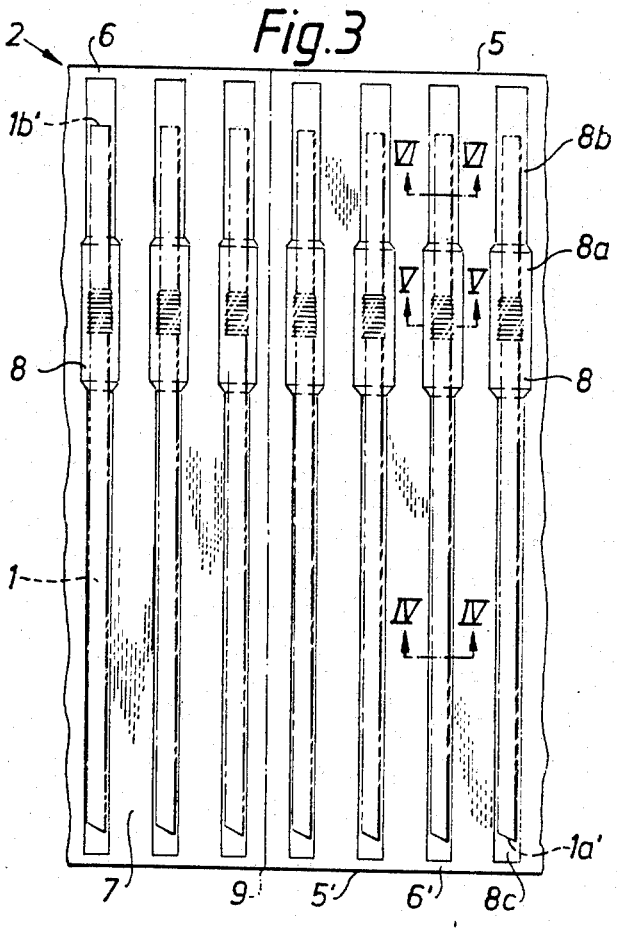
Figure 4:
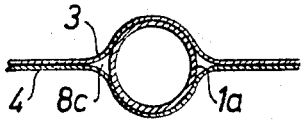
Figure 5:
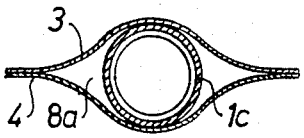
Figure 6:
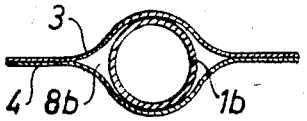

The invention will now be described and explained in greater detail with special reference to the attached schematic drawing wherein, FIG. 1 shows a conventional suction tube of the bellows-folded type, FIG. 2 shows the ringed area in FIG. 1 somewhat enlarged and partly in section, FIG. 3 shows a part of a weblike suction tube package in accordance with the invention, FIGS. 4–6 show sectional views of the suction tube package in FIG. 3 along lines IV—IV, V—V and VI—VI respectively, and FIG. 7 finally shows how an individual suction tube package in accordance with the invention can be applied to a packing container of a known type.

In FIG. 1 is shown accordingly an example of a conventional suction tube 1 of the type comprising two straight tube parts 1*a* and 1*b* joined to one another flexibly by means of a flexible tubular intermediate part 1c. The suction tube 1 is manufactured from flexible, but dimensionally relatively rigid plastic material by extrusion, the flexible intermediate part 1*c* being produced through heating and mechanical processing in a manner known to those versed in the art, so as to form the annular bellows-folded outer configuration which is shown in greater detail in FIG. 2. One of the two straight tube parts, 1*a*, of the suction tube 1 is somewhat longer and is intended to function as the insertion end when the suction tube is to be used for emptying the contents of a packing container. In order to facilitate the penetration of the tube part 1*a* through the container wall its free end 1*a*′ appropriately is cut obliquely so as to form a sharp edge. The other or shorter suction tube part 1b has a straight cut free end 1*b*′. The dimensions of the suction tube 1 may vary, of course, depending on which type of packing container the suction tube is intended for, but it can be said in general that the longer straight tube part 1*a*, inserted into the packing container, e.g. through a suction tube hole provided in the top wall of the container, ought to be sufficiently long, at least to reach as far as the bottom of the packing container. As an example functioning well in practice of a suction tube in a conventional parallelepipedic packing container of the Tetra Brik (registered trademark) type of 250 ml volume a suction tube may be mentioned of a total straight length of 150 mm, whereof the longer straight tube part 1*a* takes up 106 mm and the shorter tube part 1*b* measures 35 mm, whilst the flexible intermediate part 1*c*, which in the example shown here comprises 9 annular bellows folds 1*c*′ (FIG. 2) takes up approx. 9 mm. The suction tube 1 here is of a substantially circular geometric outer shape with a diameter of 4 mm (but one or more millmeters larger in the region of the bellows-folded portion 1*c*), the material thickness d, which preferably is uniform along the whole length of the suction tube, amounts to approx. 0.2. mm. The choice of material for the manufacture of the suction tube 1, as mentioned previously, falls on a flexible, dimensionally relatively stable plastic material, such as for example polypropylene, polystyrene or HDPE (high density polyethylene). The longer straight tube part 1a is cut off appropriately along a line which forms an angle of approximately 30° to the horizontal, since an insertion end so formed is sufficiently sharp in order to penetrate readily a weakened portion of the container wall whilst at the same time it is sufficiently rigid not to buckle or be deformed in any other way on insertion.

FIG. 3 shows a part of a weblike package 2 in accordance with the invention for suction tubes 1 of the type as described above. As is evident from the Figure the package 2 comprises two flexible material webs 3 and 4 between which the suction tubes 1 are placed with equal spacing transversely to the longitudinal edges 5 and 5' of the webs. The material webs 3 and 4 which preferably consist of a sealable plastic material, such as polypropylene, are joined to each other (preferably through so-called heat sealing) to form narrow axial sealing joints 6 and 6' along the web edges 5 and 5' respectively and transverse sealing joints 7 in the regions between the individual suction tubes 1. The sealing between the material webs 3 and 4 is realized so that the said sealing joints 6, 6' and 7 in pairs jointly delimit closed spaces 8 wherein the suction pipes 1 are arranged. As is evident from FIG. 3, the suction pipes 1 are oriented straight with their free ends 1*a*' and 1*b*' directed away from one another towards the respective web edges 5' and 5.

Figure 7:
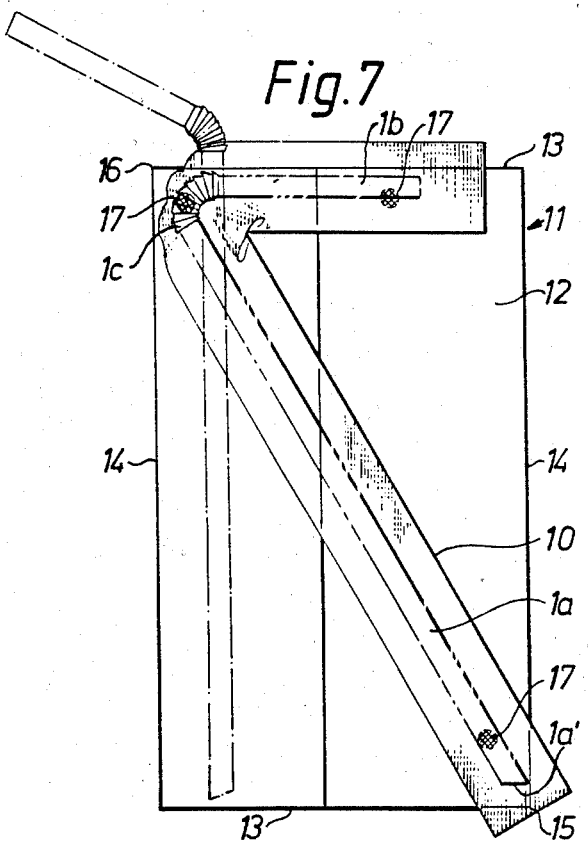

Individual packing units 10 clipped off or cut off from the weblike package 2 along dividing lines 9 in between the suction tubes 1 are intended in accordance with the invention to be fixed detachably to the outside of consumer packages 11 for beverages, e.g. juice, in the manner as shown in detail in FIG. 7. The packing container 11 shown in this example is assumed to be a conventional parallelepipedic container of the Tetra Brik (registered trade-mark) type comprising plane rectangular side walls (whereof only one of the two larger side walls 12 of the container 11 is shown in FIG. 7). On application, which is performed mechanically with the help of a so-called suction tube applicator, the packing container 11 or the unfolded packing unit 10 is oriented so that the longer straight suction tube part 1*a* of the suction tube 1 will be located wholly within the boundary lines 13 and 14 of the container wall 12, with the free end 1*a*' of the suction tube part pointing towards a lower container corner 15 and with the bellows-folded intermediate portion 1*c* of the suction tube 1 located in the region of the diagonally opposite upper package corner 16. The shorter straight tube part 1*b* of the suction tube is then folded down to parallel alignment with the top boundary line 13 of the package wall 12. The package unit 10, which accordingly is in the shape of a reversed figure seven, is then attached to the package wall 12 with the help of spots of glue (at 17), e.g. so-called hot-melt, applied to the wall 12.

In order to make the said folding down of the shorter straight tube part 1*b* of the suction tub 1 altogether possible without "bursting" the package unit 10 at the bent intermediate portion 1*c*, the space 8 is provided with a space portion 8*a* (FIG. 5) of a somewhat larger cross-sectional area in the region of the bellows-folded intermediate part 1*c* of the suction tube 1. Owing to this "enlarged" free space 8*a*, the necessary relative displacement between the suction tube 1 and the surrounding envelope, which inevitably occurs when the shorter straight tube part 1*b* is bent, is made possible, or is made easier. As is evident from FIG. 3 this space 8*a* also comprises neighbouring portions of the two straight tube parts 1*a* and 1*b* of the suction tube 1. The said folding is facilitated further in accordance with the invention in that the space portion 8*b* of the space 8 located in the region of the shorter straight suction tube part extends axially beyond this suction tube part so as to form a free expansion space between the free end 1*b*' of the tube part and the neighbouring axial sealing joint 6 adjacent to the web edge 5. The space portion 8b is provided with a cross-sectional area which is slightly larger than the outer diameter of the suction tube part 1*b*, but smaller than the cross-sectional area of the aforementioned space portion 8*a* in the region of the bellows-folded intermediate part 1*c* of the suction tube 1. To achieve a reasonably good fixing in position of the longer straight tube part 1*a* of the packed suction tube 1, the transverse sealing joints 7 are preferably realized so in accordance with the invention that the corresponding space portion 8*c* has a cross-sectional area which substantially corresponds to the geometrical outer configuration of the longer straight suction tube part 1*a* and, moreover, extends axially beyond this suction tube part so as to form a corresponding axially free expansion space between the free end 1*a*' of the suction tube part 1*a* and the neighbouring axial sealing joint 6' adjoining the web edge 5'.

I claim:

1. A flexible, weblike package for suction tubes of the type comprising two straight tube parts joined to one another flexibly by means of a bellows-folded, tubular intermediate part, the package comprising two flexible material webs which are joined to one another along repeated longitudinal and transversal sealing joints which in pairs jointly form closed spaces wherein suction tubes are arranged, the improvement comprising: the suction tubes being oriented straight with the free ends of both their straight tube parts directed away from one another towards the neighboring longitudinal edges of the material webs, and the spaces being provided with portions of mutually differing cross-sectional areas, the space portion in the region of the bellows-folded intermediate part having the largest cross-sectional area and comprising also the nearest parts of the two straight suction tube parts on either side of the bellows-folded intermediate part.

2. A package in accordance with claim 1, wherein the space portion in the region of the one, preferably shorter straight suction tube part has a cross-sectional area which is slightly greater than the geometrical outer configuration of the suction tube part, but smaller than the cross-sectional area of the space portion in the region of the bellows-folded intermediate part.

3. A package in accordance with claim 2, wherein the space portion for the shorter straight suction tube part extends axially a bit beyond the free end of the suction tube part so as to form a free expansion space between the free end and the web edge.

4. A package in accordance with claim 1, wherein the space portion in the region of the other, preferably longer straight suction tube part has a cross-sectional area which is smaller than the cross-sectional areas of the space portions and which closely agrees with the geometrical outer configuration of the straight suction tube.

5. A package in accordance with claim 4, wherein the space portion for the longer straight suction tube part extends axially beyond the free end of the suction tube part so as to form a free expansion space between the free end and the web edge.

* * * * *